US008183773B2

(12) United States Patent
Son

(10) Patent No.: US 8,183,773 B2
(45) Date of Patent: May 22, 2012

(54) PLASMA DISPLAY PANEL WITH AUXILIARY DISCHARGE SPACE AND METHOD OF MANUFACTURING THE SAME

(75) Inventor: Seung-Hyun Son, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 147 days.

(21) Appl. No.: 12/461,417

(22) Filed: Aug. 11, 2009

(65) Prior Publication Data

US 2010/0039021 A1 Feb. 18, 2010

(30) Foreign Application Priority Data

Aug. 12, 2008 (KR) ..... 10-2008-0078719

(51) Int. Cl.
*H01J 17/49* (2006.01)
*H01J 1/62* (2006.01)

(52) U.S. Cl. ..... 313/582; 313/584; 313/585; 315/169.4

(58) Field of Classification Search ..... 313/581–587, 313/44–47; 361/681, 682, 688–747; 349/905; 348/747, 749, 789, 836–841
See application file for complete search history.

(56) References Cited

U.S. PATENT DOCUMENTS

| | | | | |
|---|---|---|---|---|
| 7,400,092 | B2 * | 7/2008 | Park et al. | 313/582 |
| 2005/0029940 | A1 * | 2/2005 | Rhee | 313/582 |
| 2006/0051708 | A1 | 3/2006 | Lim et al. | |
| 2007/0194716 | A1 * | 8/2007 | Park et al. | 313/582 |
| 2007/0236145 | A1 * | 10/2007 | Kang et al. | 313/582 |
| 2008/0061692 | A1 * | 3/2008 | Miura et al. | 313/582 |
| 2008/0174242 | A1 | 7/2008 | Soh et al. | |
| 2009/0128035 | A1 * | 5/2009 | Nam et al. | 313/585 |

FOREIGN PATENT DOCUMENTS

| | | | |
|---|---|---|---|
| JP | 10-064433 | A | 3/1998 |
| JP | 2005-174850 | A | 6/2005 |

OTHER PUBLICATIONS

Tachibana et al.,Japanese Patent Application Publication, 2005-174580, Jun. 2005, machine translation.*
European Search Report in EP 09167551.2, dated Oct. 25, 2010 (SON).
European Office Action in EP 09167551.2, dated Mar. 29, 2011 (SON).

* cited by examiner

*Primary Examiner* — Tracie Y Green
(74) *Attorney, Agent, or Firm* — Lee & Morse, P.C.

(57) ABSTRACT

A plasma display panel (PDP) including a front substrate and a rear substrate facing each other, a partition wall interposed between the front substrate and the rear substrate to define a plurality of unit cells, each unit cell including a main discharge space, an auxiliary discharge space, and a step space, the auxiliary discharge space and the step space being on opposite sides of the main discharge space along a stepped sidewall of the partition wall, pairs of scanning and sustain electrodes arranged adjacent the auxiliary discharge spaces and to the step spaces, respectively, address electrodes extending to cross the scanning electrodes at a location adjacent to the auxiliary discharge spaces, a phosphor layer formed at least in the main discharge spaces, and discharge gas filling the unit cell.

19 Claims, 12 Drawing Sheets

PLASMA DISPLAY PANEL WITH AUXILIARY DISCHARGE SPACE AND METHOD OF MANUFACTURING THE SAME

BACKGROUND

1. Field

Embodiments relate to a plasma display panel (PDP) and method of manufacturing the same and, more particularly, to a PDP in which an address discharge path is shortened so that low-voltage addressing is possible, and having symmetric discharge in each unit cell realizing a predetermined image, thereby improving overall displaying quality.

2. Description of the Related Art

In a PDP, a plurality of discharge cells arranged in a matrix form is interposed between upper and lower substrates facing each other. Discharge electrodes including pairs of scanning electrodes and sustain electrodes, which cause mutual discharge, and a plurality of address electrodes are disposed on the substrates. An appropriate discharge gas is injected between the substrates, a predetermined discharge pulse is applied between discharge electrodes, fluorescent substances applied within the plurality of discharge cells are excited, and a predetermined image is realized using generated visible light.

In such a PDP, one image frame is divided into a plurality of sub-fields each having different light emitting frequency and is time-shared operated to realize a grey scale image. Each sub-field includes a reset period to uniformly generate discharge, an address period to select the plurality of discharge cells, and a sustain period to realize the grey scale according to discharge frequency. During the address period, auxiliary discharge occurs between the address electrodes and the scanning electrodes so that wall charge results in selected discharge cells, and thus, a condition suitable for the auxiliary discharge is created.

In general, a high voltage, i.e., a voltage higher than a sustain discharge, is required during the address period for selecting a discharge cell to be displayed. Moreover, as the PDP rapidly develops to a full high definition (HD) level, the number of the discharge cells increases in geometrical proportion, increasing power consumption by a circuit unit in proportion to the number of address electrodes allocated to each discharge cell. In addition, in a so-called high Xenon (Xe) display in which a partial pressure of Xe is increased within the discharge gas injected into the panel, a light-emitting efficiency is increased. A relatively high address voltage, however, is required for discharge initiation in such a high Xe display, further increasing power consumption.

SUMMARY

Embodiments are therefore directed to a PDP and method of manufacturing the same, which substantially overcome one or more of the problems due to the limitations and disadvantages of the related art.

It is therefore a feature of an embodiment to provide a highly efficient PDP that enables address driving with a low voltage.

It is therefore another feature of an embodiment to provide a PDP in which light-emitting efficiency is remarkably improved by realizing a high xenon (Xe) display.

It is therefore another feature of an embodiment to provide a high-quality PDP in which symmetric discharge is generated in each unit cell where a predetermined image is realized, and thus, an overall display quality of the PDP is improved.

It is therefore another feature of an embodiment to provide a PDP in which consumption of reactive power, which does not contribute to light emitting luminance, may be reduced and discharge intervention between neighboring cells is prevented.

At least one of the above and other features and advantages may be realized by providing PDP including a front substrate and a rear substrate facing each other, a partition wall interposed between the front substrate and the rear substrate to define a plurality of unit cells, each unit cell including a main discharge space, an auxiliary discharge space, and a step space, the auxiliary discharge space and the step space being on opposite sides of the main discharge spaces along a stepped sidewall of the partition wall, pairs of scanning and sustain electrodes arranged adjacent the auxiliary discharge spaces and to the step spaces, respectively, address electrodes extending to cross the scanning electrodes at a location adjacent to the auxiliary discharge spaces, a phosphor layer formed at least in the main discharge spaces, and discharge gas filling the unit cell.

The auxiliary discharge spaces and the step spaces may be connected to the main discharge spaces and form the unit cells with the main discharge spaces.

The auxiliary discharge space and the step space may be symmetrical to each other with respect to the main discharge space.

The sustain electrodes and the scanning electrodes may have an electrode arrangement of X-X-Y-Y, the sustain electrodes being X and the scanning electrodes being Y, so that the sustain electrodes and the scanning electrodes neighbor each other in adjacent cells.

The stepped sidewall of the partition wall may include a base part and a projection part that projects from a center of the base part, the base part being wider than the projection part to define a step form on each side of the projection part.

The width of the base part of the partition wall may be substantially the same as a distance between an outer edge of one bus electrode to an outer edge of an adjacent bus electrode in an adjacent unit cell, the outer edge of each bus electrode facing away from its corresponding adjacent bus electrode.

The base parts and respective bus lines of the scanning electrodes may at least partially cover each other and may be arranged to overlap each other.

The base part and the bus lines of the scanning electrodes may overlap each other at end parts adjacent to the main discharge space.

The PDP may further include an electron emission material layer on a top surface of the base part in the auxiliary discharge space.

The electron emission material layer may be continuously formed along the top surface of the base part in the auxiliary discharge space and a side of the projection part in the auxiliary discharge space.

The electron emission material layer may be formed on the main discharge space as well as along the top surface of the base part in the auxiliary discharge space and a side of the projection part in the auxiliary discharge space.

A side of the base part may concave away from the main discharge space.

A side of the base part may convex toward the main discharge space.

The phosphor layer may not be formed on the top surface of the base part in the auxiliary discharge space.

The phosphor layer may be extended to the step spaces on one side of the main discharge space.

The phosphor layer may be extended to the step spaces and the auxiliary discharge spaces on both sides of the main discharge spaces.

The phosphor layer may be formed to have a maximum thickness in the main discharge spaces.

The maximum thickness may be substantially the same as a height of the stepped surface of the partition wall.

A high xenon (Xe) gas may be used as the discharge gas.

At least one of the above and other features and advantages may be realized by providing a method of manufacturing a PDP, method including interposing a partition wall between opposing front and rear substrates to define a plurality of unit cells including main discharge spaces, auxiliary discharge spaces, and step spaces, the auxiliary discharge space and the step space being on opposite sides of the main discharge spaces along a stepped surface of the partition wall, disposing pairs of sustain electrodes and scanning electrodes on the front substrates, the sustain electrodes being arranged close to the auxiliary spaces and the scanning electrodes being arranged close to the step spaces, disposing a plurality of address electrodes on the rear substrates, the address electrodes extending to cross the scanning electrodes at a location at least adjacent to the auxiliary discharge spaces, forming a phosphor layer at least in the main spaces, and filling discharge gas in the main discharge spaces, auxiliary discharge spaces, and the step spaces.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Figure 1:
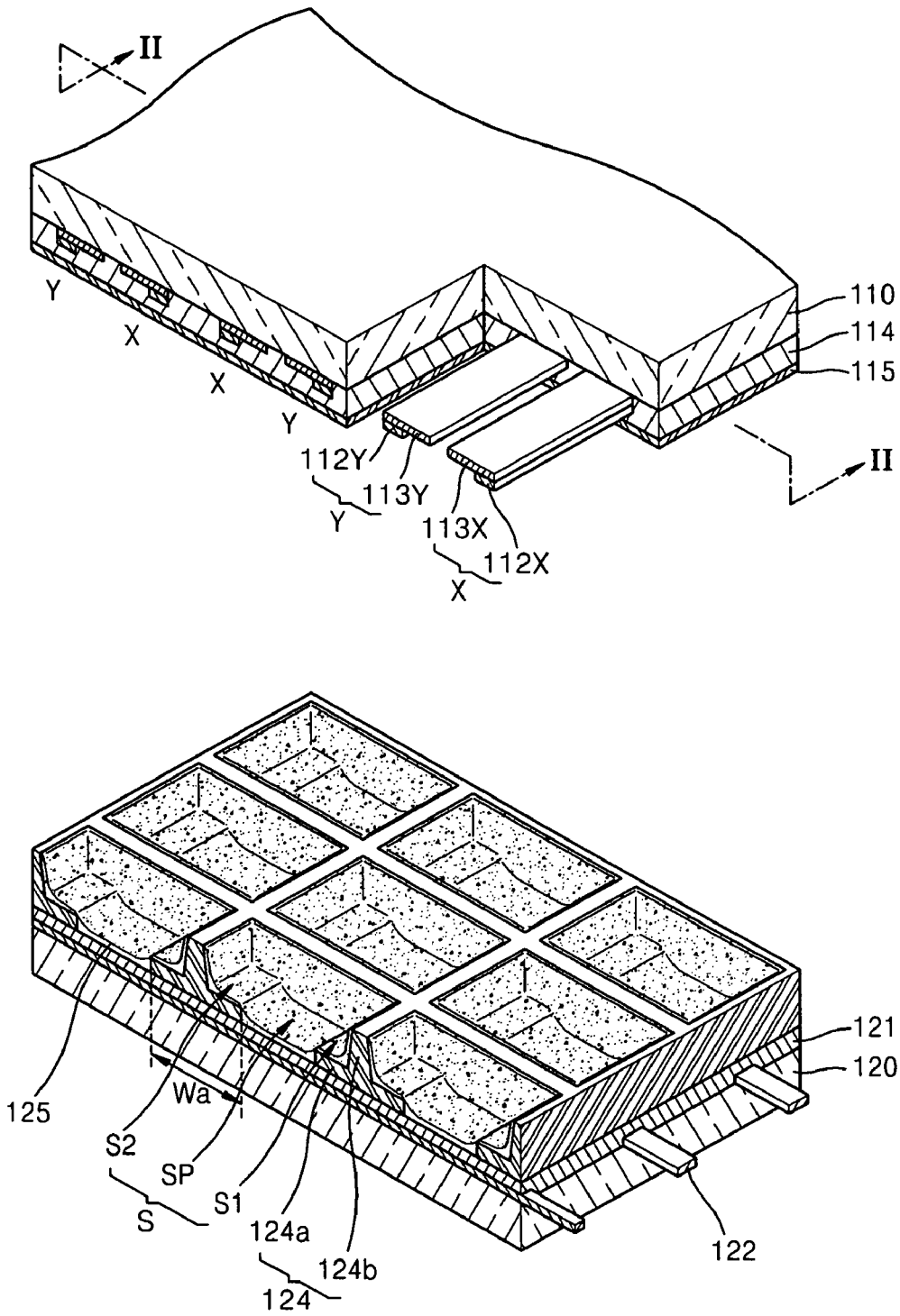
FIG. 1 illustrates an exploded perspective view of a PDP according to an embodiment.

Korean Patent Application No. 10-2008-0078719, filed on Aug. 12, 2008, in the Korean Intellectual Property Office, and entitled: "Plasma Display Panel," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
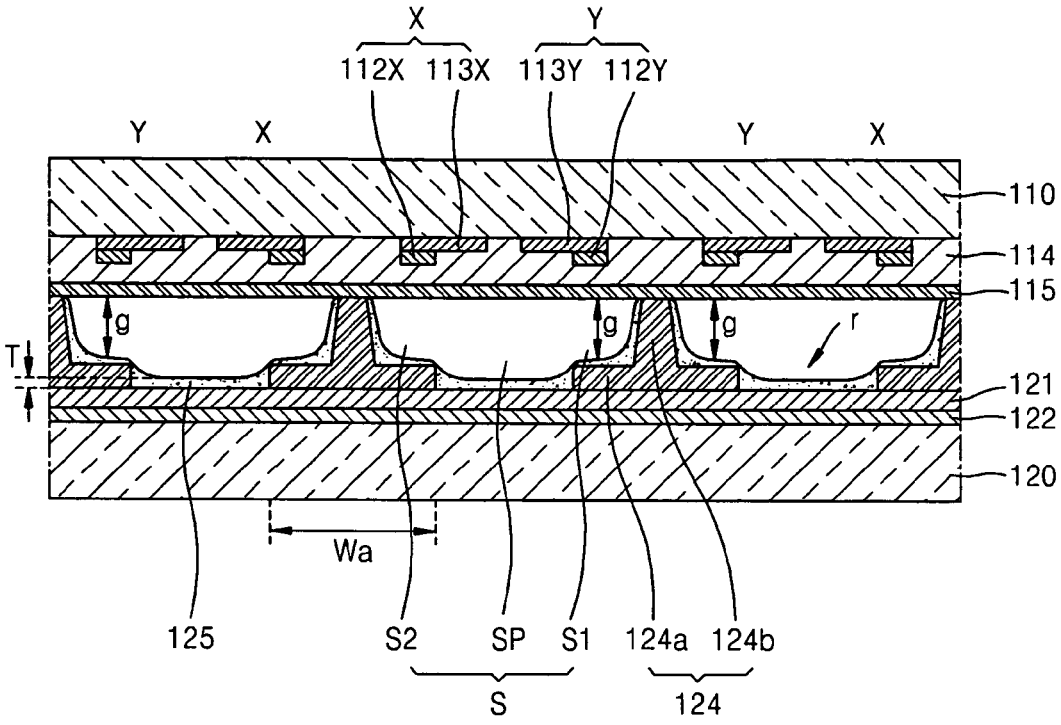
FIG. 2 illustrates a cross-sectional view of the PDP illustrated in FIG. 1, taken along line II-II of FIG. 1.

FIG. 1 illustrates an exploded perspective view of a PDP according to an embodiment. FIG. 2 illustrates a cross-sectional view of the PDP illustrated in FIG. 1, taken along line II-II of FIG. 1.

The PDP may include a front substrate 110, a rear substrate 120, and a partition wall 124. The front substrate 110 and the rear substrate 120 may be spaced apart and facing each other, and the partition wall 124 may partition a space between the front substrate 110 and the rear substrate 120 into a plurality of unit cells S. The unit cell S partitioned by the partition wall 124 may be a minimum light emitting unit for realizing a predetermined display. The unit cell S may include a pair of sustain and scanning electrodes X and Y, arranged to generate mutual display discharge, and an address electrode 122 extending in a direction perpendicular to the pair of sustain and scanning electrodes X and Y. The unit cell S may form a separate light emitting region from neighboring unit cells S. The sustain electrode X and scanning electrode Y may include a bus electrode 112X and a transparent electrode 113X and a bus electrode 112Y and a transparent electrode 113Y, respectively. The bus electrodes 112X and 112Y may function as supply lines of a driving power source and may extend across the unit cell S. The transparent electrodes 113X and 113Y may be formed of optically transparent conductive materials.

The address electrode 122 may be disposed on the rear substrate 120, and may perform address discharge along with the scanning electrode Y. Here, the address discharge that precedes the display discharge may be denoted as an auxiliary discharge supporting the display discharge by accumulating priming particles in each unit cell S. The address discharge may mainly be generated in an auxiliary discharge space S1 defined by the partition wall 124. That is, the address discharge may occur at the auxiliary discharge space S1 where the scanning electrode Y and the address electrode 122 cross each other or at least at a position adjacent to the auxiliary discharge space S1.

A discharge voltage applied between the scanning electrode Y and the address electrode 122 may be centralized in the auxiliary discharge space S1 by a dielectric layer 114, covering the scanning electrodes Y, and the partition wall 124 disposed on the address electrode 122. Therefore, a high electric field sufficient for discharge initiation may be formed in the auxiliary discharge space S1. The auxiliary discharge space S1 may not be physically partitioned by other wall structures, but may extend from a main discharge space SP to form a space, e.g., the unit cell S, with the main discharge space SP.

The priming particles formed in the auxiliary discharge space S1 due to the address discharge may naturally be diffused to the main discharge space SP and may participate in the display discharge. The auxiliary discharge space S1 may be defined by the partition wall 124 that is stepped, and may have a smaller discharge volume than the main discharge space SP. A step space S2 may be formed on the side of the sustain electrode X. Thus, the step space S2 may be symmetrical to the auxiliary discharge space S1 with respect to the main discharge space SP.

The address electrode 122 may be covered by a dielectric layer 121 disposed on the rear substrate 120, and the partition wall 124 may be formed on a top surface of the dielectric layer 121 that is evenly formed. The partition wall 124 may be shaped like a step with a base part 124*a* and a projection part 124*b*. The base part 124*a* may have a width Wa, larger than the width of the projection part 124*b*, and may be interposed between the front substrate 110 and the rear substrate 120. The base part 124*a* may be on the dielectric layer 121. The projection part 124*b* may be projected toward the front substrate 110 from a center of the base part 124*a*. The projection part 124*b* may be in contact with a protective layer 115.

The dielectric layer 114 and/or a protective layer 115 covering the scanning electrode Y and the base part 124*a* disposed on the address electrodes 122 may form discharge surfaces facing each other and, thus, may enable address discharge to occur mainly within the auxiliary discharge space S1. In other words, the electrical field may be mainly centralized in the auxiliary discharge space S1 by high permittivity of the dielectric layer 114 and/or the protective layer 115 covering the scanning electrode Y and the partition wall 124 formed on the address electrode 122. Further, opposing discharge with the top surface of the dielectric layer 114 and the bottom surface of the base part 124*a* as main discharge surfaces may be generated in the discharge space S1.

Conventionally, discharge is generated between the scanning electrode Y and the address electrode 122 through a long-distance discharge path, e.g., the height of the unit cell. According to the wall structure of the current embodiment in which the base part 124*a* with a predetermined height is projected toward the scanning electrode Y and extends into the unit cell, a discharge path between the scanning electrode Y and the address electrode 122 may, however, be shortened to a size of a discharge gap g.

The discharge gap g may have a distance that is substantially same as the distance between a bottom surface of the protective layer 115 and an upper surface of the base part 124*a*. Therefore, the driving consumption power may be reduced because the same amount of priming particles may be generated by using a lower address voltage. Furthermore, light-emitting efficiency may be improved since more priming particles may be generated by using the same address voltage used in the prior art. The partition wall 124 may be formed of a material having permittivity higher than a predetermined value and, thus, a high address electric field in the auxiliary discharge space S1 may be formed through the base part 124*a* of the partition wall 124. For example, the partition wall 124 may be formed of a dielectric material including PbO, $B_2O_3$, $SiO_2$, and $TiO_2$.

Figure 3:
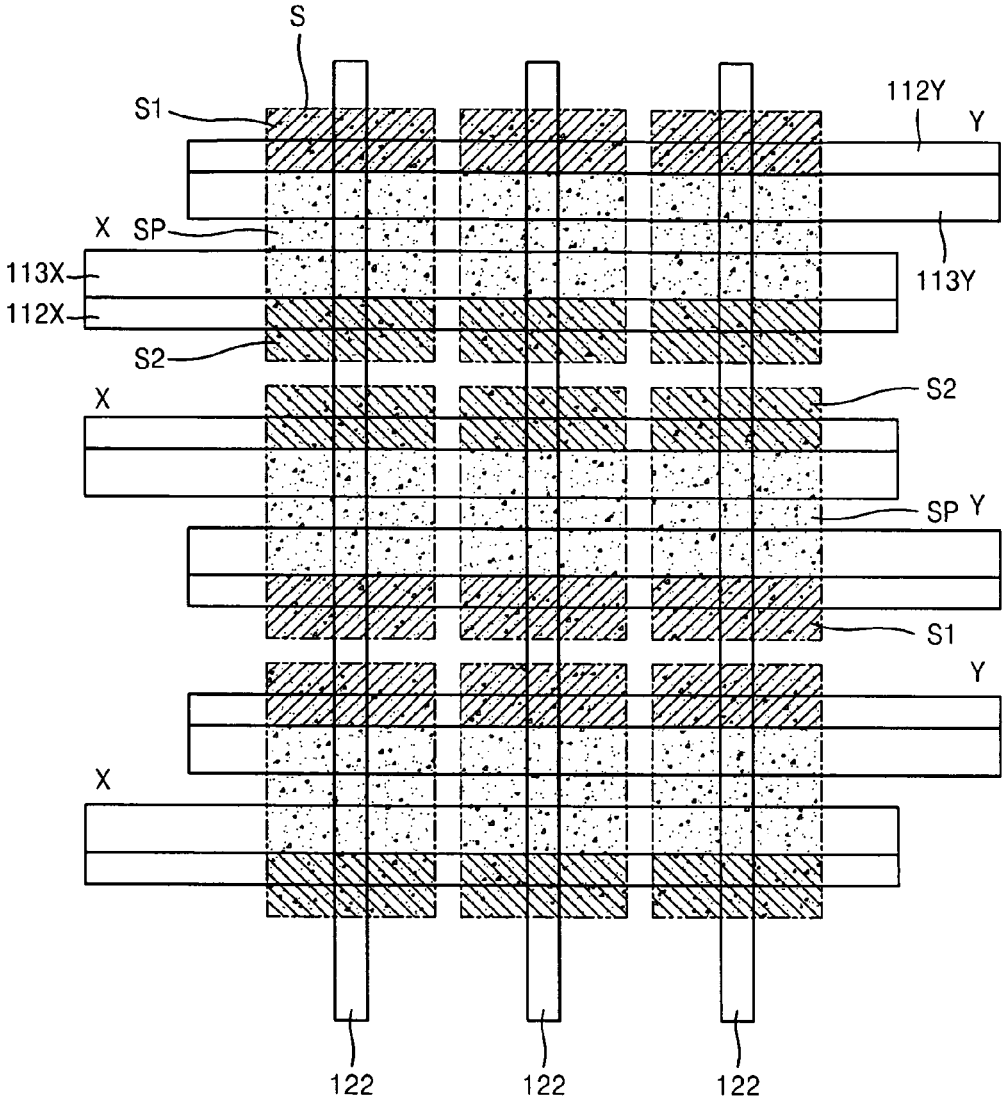
FIG. 3 illustrates a plan view of an arrangement of scanning electrodes and sustain electrodes of FIG. 1.

FIG. 3 illustrates a plan view of an arrangement between the scanning electrodes Y and the sustain electrodes X.

Referring to FIG. 3, the scanning electrodes Y and the sustain electrodes X may not be alternatively arranged, e.g., XYXY, but instead, may be arranged such that electrodes of the same kind neighbor each other in the adjacent unit cells S, e.g., YXXY. More specifically, since the scanning electrode Y, the sustain electrode X, the sustain electrode X, and the scanning electrode Y may be sequentially arranged in this order, one sustain electrode X may be arranged to neighbor the sustain electrode X of the adjacent unit cell S, while one scanning electrode Y may be arranged to neighbor the scanning electrode Y of the adjacent unit cell S. If the scanning electrode Y, the sustain electrode X, the scanning electrode Y, and the sustain electrode X are alternatively arranged in this order, the scanning electrode Y and the sustain electrode X in the adjacent unit cell S may be arranged to neighbor each other. Thus, mis-discharge, e.g., sustain discharge exceeding the boundary of the unit cell S, may potentially be generated.

In addition, because the scanning electrode Y and the sustain electrode X neighbor each other according to the alternating arrangement of the electrodes, a high capacitance value may be formed between the scanning electrode Y and the sustain electrode X based on various paths. For example, since the dielectric layer 114 have a permittivity that is higher than discharge gas by about 12 times, reactive power consumption may be increased and driving efficiency may be decreased. Thus, by arranging the electrodes such that the same kind of electrodes neighbors each other, mis-discharge may be prevented and an improvement of driving efficiency may be achieved as the result of reduced reactive power.

Because the sustain and scanning electrodes X and Y may be covered by the dielectric layer 114 to be prevented from being exposed to a discharge environment, the sustain and scanning electrodes X and Y may be protected from a direct collision with charged particles that participate in the discharge. The dielectric layer 114 may be protected by being covered by the protective layer 115 formed of, e.g., a MgO film. The protective layer 115 may induce secondary electrode emission and may contribute to activate discharge.

Figure 4:
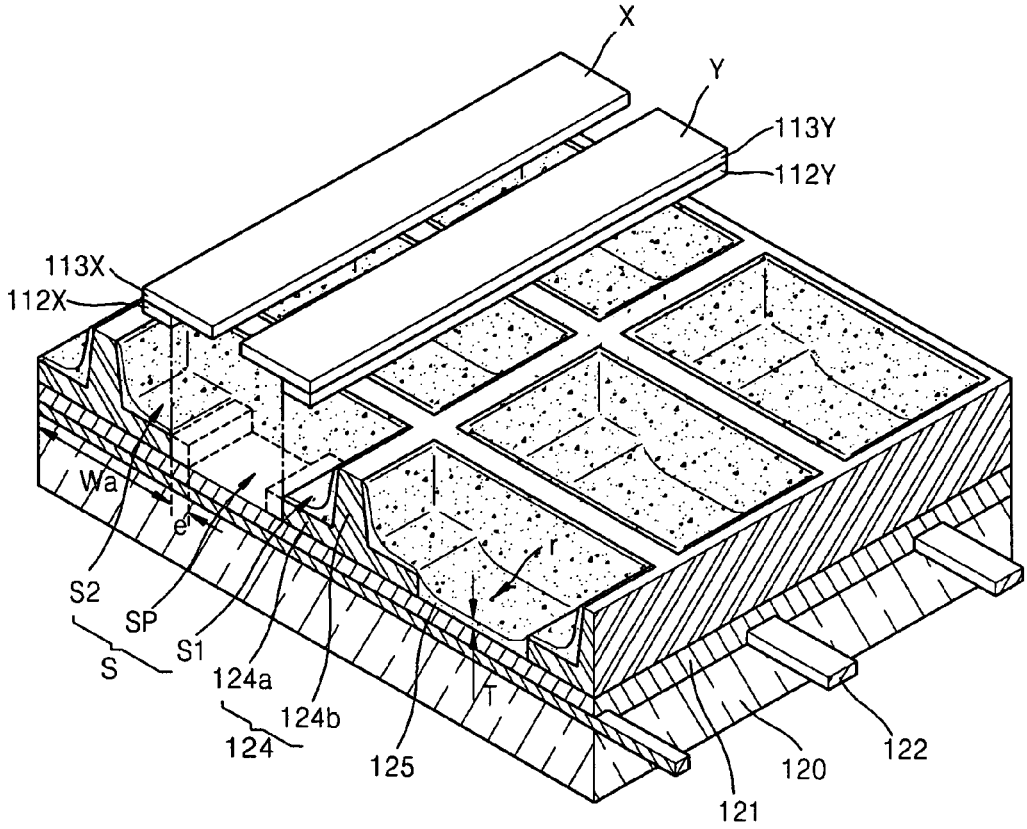
FIG. 4 illustrates an exploded perspective view of a main part of a PDP extracted from the PDP of FIG. 1.

FIG. 4 illustrates an exploded perspective view of a main part of the PDP extracted from the PDP of FIG. 1.

With regard to the structure of the partition wall 124, the width of the base part 124*a* may be related to a discharge area facing the scanning electrode Y and may also be related to a discharge volume of the whole unit cell S. For example, when a width of the base part 124*a* is adjusted to have the width Wa, the discharge area facing the scanning electrodes Y may be sufficiently large to have a smooth address discharge. Further, an area that the base part 124*a* occupies in the discharge area may be sufficiently small to increase a discharge volume. For example, the width Wa of the base part 124*a* may be substantially the same as a distance between an outer edge of one bus electrode 112Y from an outer edge of an adjacent bus electrode 112Y, i.e., an outer edge of a bus electrode 112Y in one unit cell may face away from an adjacent bus electrode 112Y of an adjacent unit cell. For example, one end, i.e., an outer edge, of the bus electrode 112Y may be arranged to correspond to, e.g., be aligned with, one end of the base part 124*a*. The bus electrode 112Y and the base part 124*a* may be arranged to overlap one another at end parts adjacent to the main discharge space.

To secure sufficient discharge area with the scanning electrode Y and to have appropriate discharge volume, one end of the bus electrode 112Y may be arranged to correspond to one end of the base part 124*a*. For example, one end of the bus electrode 112Y may be perpendicular to one end of the base part 124*a*. To facilitate address discharge, the bus electrode 112Y and the base part 124*a* may be arranged to overlap one another. Also, the width Wa of the base part 124*a* may be no more than a distance from one bus electrode, e.g., 112Y, to adjacent bus electrode, e.g., 112Y so that the maximum discharge volume may be secured. In consideration of an arrangement error that is generally allowed in a manufacturing process, the width Wa of the base part 124*a*, however, may be designed to be large enough to have a spare margin e. The margin e may be smaller than a half width of the main discharge space SP.

Address discharge centralized in the auxiliary discharge space S1 may provide priming particles for ignition of display discharge, instead of directly providing display discharge. When discharge light generated during address discharge is inevitably exposed to the outside along with the display luminescence, blurred luminance noise may be formed around active pixels and may decrease display definition. In the current embodiment, by using an optically opaque property of the bus electrode 112Y, which is generally formed of a metal conductive material, and by arranging the bus electrode 112Y on the base part 124*a* in which address discharge is centralized, a considerable amount of discharge light and a generation of luminance noise may be prevented, while improving a contrast property.

In the current embodiment, the auxiliary discharge space S1 formed on the side of the scanning electrode Y may be used to generate centralized address discharge. The step space S2 may be formed on the side of the sustain electrode X. Thus, the step space S2 may be symmetrical to the auxiliary discharge space S1 with respect to the main discharge space SP. Because the unit cell S is symmetrical, display discharge may not lean toward any one of the scanning electrode Y or the sustain electrode X, but instead, may have symmetrical discharge having the same discharge intensity. Accordingly, luminance distribution in the unit cell S may be symmetrical in that the luminescent center indicating the highest luminance may generally be a geometrical center of the unit cell S. Therefore, display quality deterioration due to asymmetrical luminance distribution may be prevented.

A liquid phosphor paste may be applied between the partition wall 124, e.g., main discharge space SP, and the liquid phosphor paste may harden to be a phosphor layer 125. The phosphor layer 125 may interact with ultraviolet light generated as a result of the display discharge and may generate visible light having each different color. For example, according to a color to be realized, R, G, and B phosphor layers 125 may be formed in the unit cells S, and thus, each unit cell S may be classified as R, G, and B sub-pixels. In the structure where the base part 124*a* having width Wa is disposed on both sides of the unit cell S, a groove r may be provided to hold the phosphor paste at the center of the unit cell S, and thus, the phosphor layer 125 may be centralized at the center of the unit cell S. The groove r may have a maximum height, which may be the substantially the same as a height of the base part 124*a*, at its edge. That is, while applying the phosphor paste, the flowing of the phosphor paste may be obstructed by the base part 124*a* arranged on both sides of the unit cell S, and thus, the phosphor layer 125 may be centralized at the center of the unit cell S. As the phosphor layer 125 having a maximum thickness T centralizes at the center of the unit cell S where ultraviolet rays are centralized by the display discharge occurring between the scanning electrode Y and the sustain electrode X, the conversion efficiency of the ultraviolet rays may be increased, resulting light emitting luminance to increase.

As described above, the phosphor layer 125 may be centralized in the groove r between the base parts 124*a*. Embodiments, however, are not limited thereto, and the phosphor layer 125 may also be formed in other parts of the unit cell S, i.e., the top surface of the base part 124*a* and/or a side surface of the projection part 124*b* as illustrated in FIGS. 1, 2, and 4. In particular, an application process in which the phosphor paste may be applied continuously across a row of the unit cells S may be used to form the phosphor layer 125 in other parts of the unit cell S.

Also, discharge gas may be injected into the unit cell S as a source for generating ultraviolet rays. Examples of the discharge gas may include a multi gas in which xenon (Xe), krypton (Kr), helium (He), and neon (Ne) are mixed in a fixed volume ratio. In general, a high xenon (Xe) display panel, in which a ratio of xenon (Xe) is increased, may have a high light-emitting efficiency. Because the high xenon (Xe) display panel, however, requires high initiation voltage, which further requires increased driving power consumption and redesign of a circuit to accommodate increased electric power, actual and broad applications of the high xenon (Xe) display panel may be limited. According to the present embodiment in which a high electric field suitable for address discharge is formed through the base part 124*a* of the partition wall 124, however, the sufficient priming particles for discharge ignition may be secured so that a high xenon (Xe) plasma display may be embodied without drastically increasing discharge initiation voltage, thereby, improving light-emitting efficiency.

Table 1 below shows results obtained by comparing PDPs according to the present embodiment with a conventional PDP under the same driving conditions. The light-emitting efficiency may be defined as light emitting luminance (cd/m$^2$) as an output over consumption power (W) as an input.

TABLE 1

| | Conventional PDP | PDP I According to Present Embodiment | PDP II According to Present Embodiment |
|---|---|---|---|
| Xenon (Xe) content | 11% | 11% | 15% |
| sustain discharge voltage (Vs) | 202 V | 202 V | 202 V |
| address voltage (Va) | 57 V | 57 V | 57 V |
| light-emitting efficiency (cd/m$^2$W) | 0.875 | 0.991 | 1.127 |

Comparing the light-emitting efficiency under the same driving conditions of the Xenon (Xe) content of 11%, the sustain discharge voltage of 202 V, and the address voltage of 57 V, the PDP I according to the present embodiment may obtain light-emitting efficiency higher than that of the conventional PDP by about 13.3%. The PDP II according to the present embodiment, in which the driving conditions are the same as those of the PDP I according to present embodiment, except for increasing the xenon (Xe) content from 11% to 15%, may obtain light-emitting efficiency higher than that of the PDP I according to present embodiment by about 13.7%. In comparing the PDPs I and II according to the present embodiment, although the xenon (Xe) content is increased from 11% to 15%, both PDPs may be driven with the same address voltage and sustain discharge voltage because the stepped wall structure is employed, and thereby, a high electric field may be centralized thereto.

Figure 5:
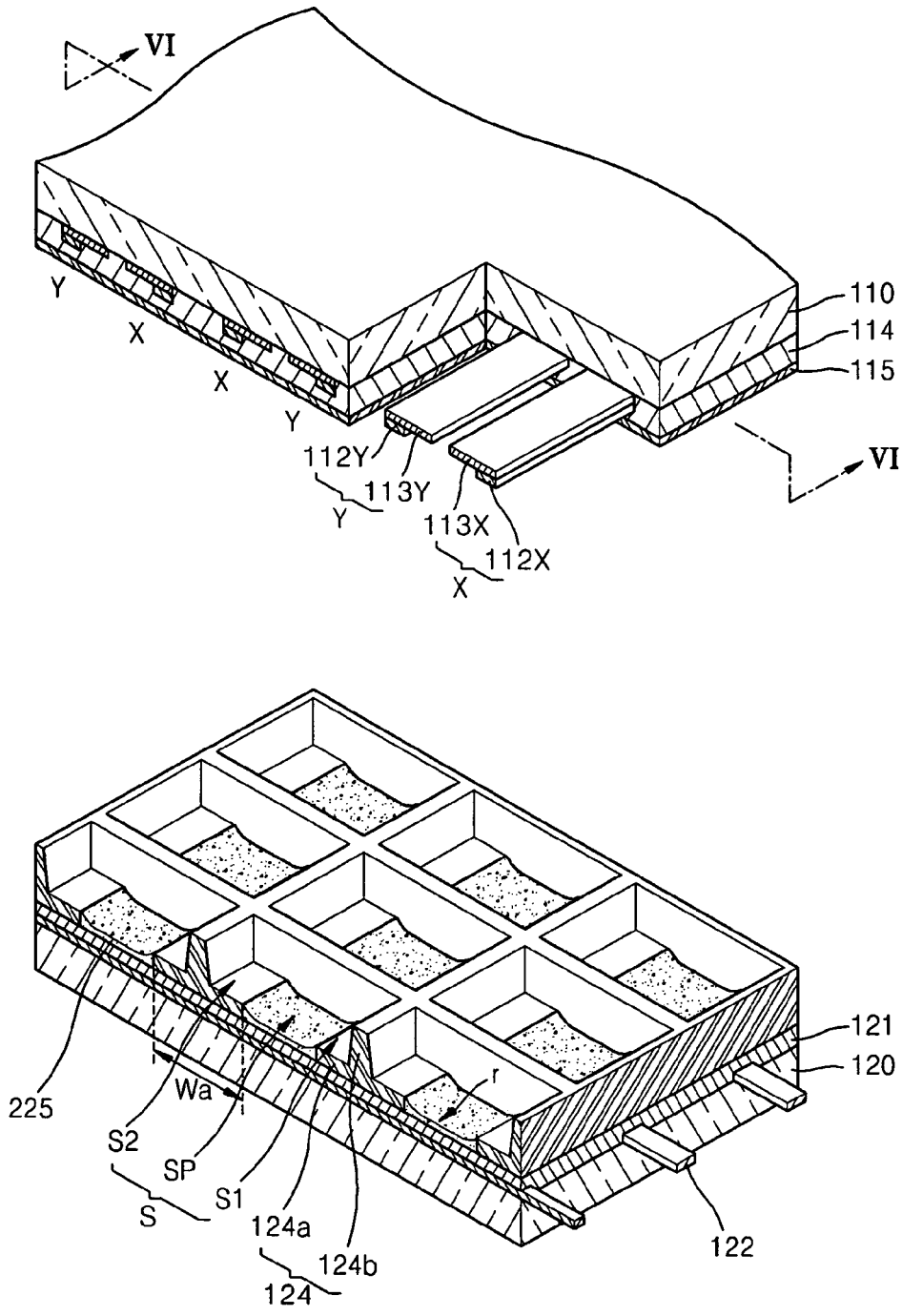
FIG. 5 illustrates an exploded perspective view between a PDP according to another embodiment.
Figure 6:
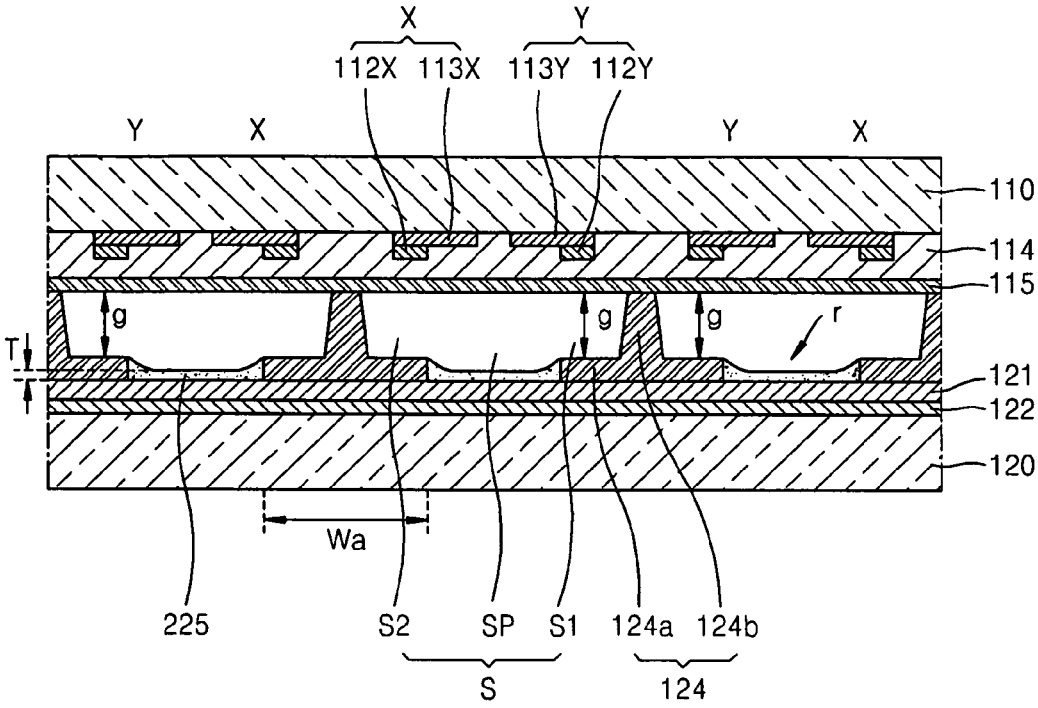
FIG. 6 illustrates a cross-sectional view of the PDP of FIG. 5, taken along line VI-VI of FIG. 5.

FIG. 5 illustrates an exploded perspective view of a PDP according to another embodiment. FIG. 6 illustrates a cross-sectional view of the PDP illustrated in FIG. 5, taken along line VI-VI of FIG. 5.

Referring to FIGS. 5 and 6, since the partition wall 124 may be interposed between the front substrate 110 and the rear substrate 120, the unit cell S may be partitioned. The unit cell S may include the main discharge space SP, the auxiliary discharge space S1 and the step space S2. The auxiliary discharge space S1 may be defined by the stepped partition wall 124 including the base part 124*a* and the projection part 124*b*. Along with the auxiliary discharge space S1, the step space S2 may be prepared on the other side of the projection part 124*b* of the partition wall 124 to symmetrically form the unit cell S. Also, the base parts 124*a* of the partition wall 124 may provide the grooves r suitable to hold the phosphor paste. A phosphor layer 225 may be formed in each of the grooves r. The groove r at its edges may have substantially the same height as the base part 124*a* of the partition wall 124. In the current embodiment, the phosphor layer 225 may not be formed on the partition wall 124 interfacing with the auxiliary discharge space S1 and, in particular, the phosphor layer 225 may not be formed on the base part 124*a*, which functions as a discharge surface with the scanning electrode Y. Hereinafter, the PDP according to the current embodiment is described more fully.

The phosphor materials, each including a different material, have different electrical characteristics that may affect a discharge environment. For example, an electric potential of the surface of a G phosphor material of a zinc silicate system, e.g., $Zn_2SiO_4$:Mn is negatively charged, whereas an electric potential of the surfaces of R and B phosphor materials, e.g., $Y(V,P)O_4$:Eu or BAM:Eu is positively charged. Thus, to eliminate discharge intervention of the phosphor materials and form a uniform discharge environment, the phosphor materials may be isolated from an address discharge path by not being applied in the auxiliary discharge space S1. If the phosphor materials are directly exposed to the address discharge path, address voltages actually applied in the auxiliary discharge spaces S1 may each be different according to the electrical characteristic of the phosphor materials even though the same address voltage is applied. In other words, since the negatively charged G phosphor material may reduce an address voltage and the positively charged R and B phosphor materials may increase an address voltage, common address voltages actually applied in the auxiliary discharge spaces S1 may each be different, and thus, an address voltage margin may be reduced.

By having the unit cell S spatially partitioned into the main discharge space SP where display discharge is centralized and the auxiliary discharge space S1 where address discharge is centralized and having the phosphor materials selectively not being applied in the auxiliary discharge space S1, an address voltage applied from the outside may not be distorted based on the electrical characteristics of the phosphor materials. Therefore, the address voltage may instead be transmitted identically to all auxiliary discharge spaces S1 so that an address voltage margin may drastically be increased. Further, the same discharge effect may be obtained even with a low address voltage since more priming particles may be accumulated when the same address voltage is being applied, and discharge intensity may be increased in a display discharge. In addition, the phosphor materials may not be applied in the auxiliary discharge space S1 where address discharge is centralized so that background light by phosphor materials may be removed during address discharging and a high-quality display having high contrast may be realized.

Figure 7:
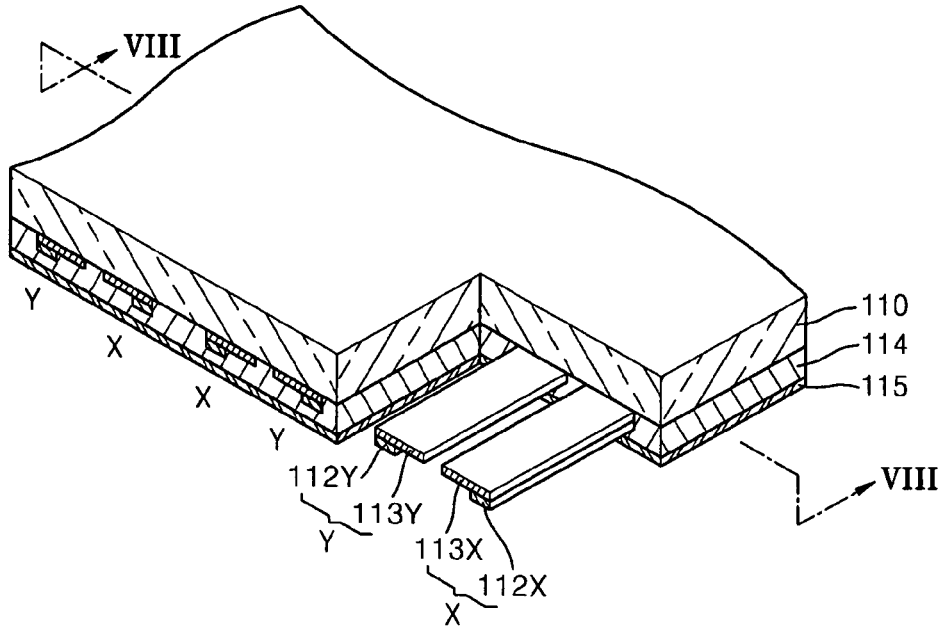
FIG. 7 illustrates an exploded perspective view of a PDP according to another embodiment.
Figure 7:
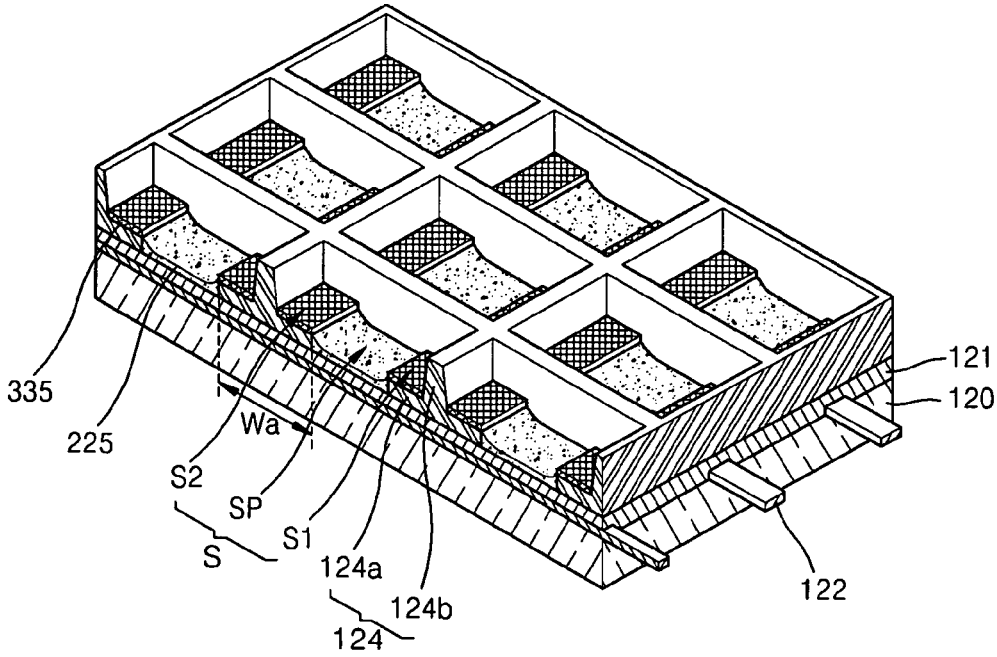
Figure 8:
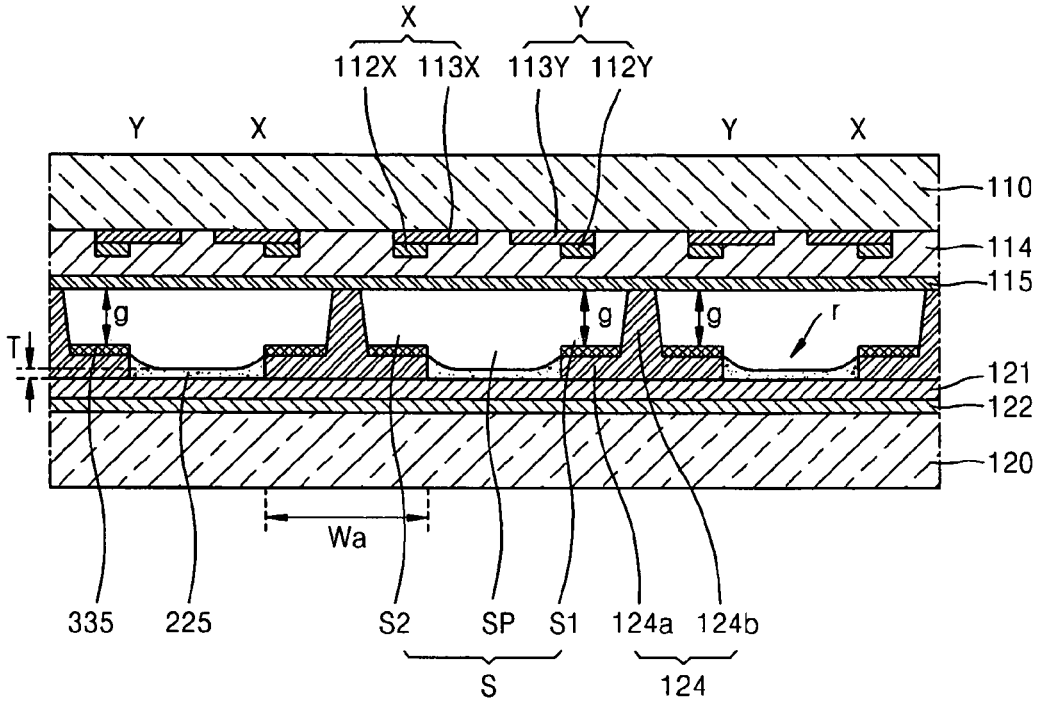
FIG. 8 illustrates a cross-sectional view of the PDP of FIG. 7, taken along line VIII-VIII of FIG. 7.

FIG. 7 illustrates an exploded perspective view of a PDP according to another embodiment, and FIG. 8 illustrates a cross-sectional view of the PDP illustrated in FIG. 7, taken along line VIII-VIII of FIG. 7.

Referring to FIGS. 7 and 8, since the stepped partition wall 124 is interposed between the front substrate 110 and the rear substrate 120, the unit cell S may be partitioned. The main discharge space, the auxiliary discharge space S1 adjacent to and connecting to the main discharge space SP, and the step space S2 may be formed by the stepped partition wall 124 including the base part 124*a* and the projection part 124*b*. Also, the auxiliary discharge space S1 and the step space S2 respectively formed in left and right sides of the partition wall 124 may be symmetrical to each other with respect to the main discharge space SP, and thus, the unit cell S may be formed in a symmetrical form. In particular, in the current embodiment, an electron emission material layer 335 may be formed on the top surface of the base part 124*a* which faces the scanning electrode Y. The electron emission material layer 335 may include materials inducing electron emission in response to discharge electrical fields. Examples of the materials inducing electron emission may include MgO nano powder, a Sr—CaO thin film, Carbon powder, Metal powder, MgO paste, ZnO, BN, MIS nano powder, OPS nano powder, ACE, and CEL. The electron emission material layer 335 may provide secondary electrons to the auxiliary discharge space S1 in response to a high electrical field centralized in the auxiliary discharge space S1 so that discharge ignition may be facilitated and discharge may be activated. The electron emission material layer 335 may also be provided in the step space S2 to maximize symmetry within the cell.

Figure 9:
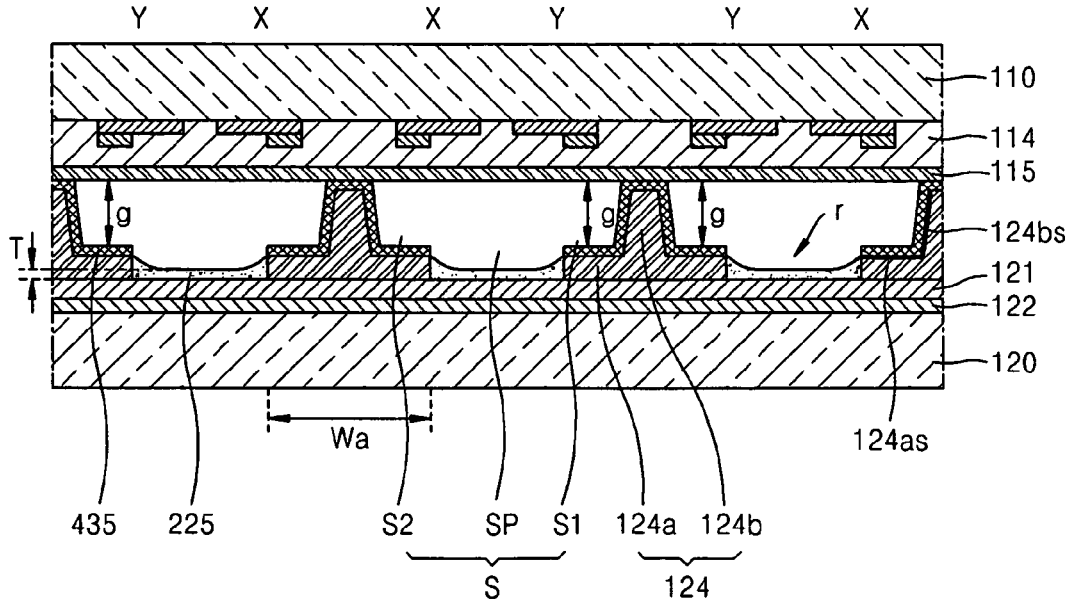
FIG. 9 illustrates a cross-sectional view of a modified PDP of FIG. 8.

FIG. 9 illustrates a cross-sectional view of a modified PDP of FIG. 8.

Referring to FIG. 9, electron emission material layers 435 may be applied along the interface of the partition wall 124 and the auxiliary discharge space S1. That is, the electron emission material layers 435 may be on side 124*bs* of the projection part 124*b* and top surface 124*as* of the base part 124*a*, i.e., on auxiliary space S1. Since the high address electrical field formed in the auxiliary discharge space S1 is efficiently used and the electron emission material layers 435 are extended along the stepped partition wall 124 interfacing with the auxiliary discharge space S1, electron emission may be reinforced and discharge may be activated.

Figure 10:
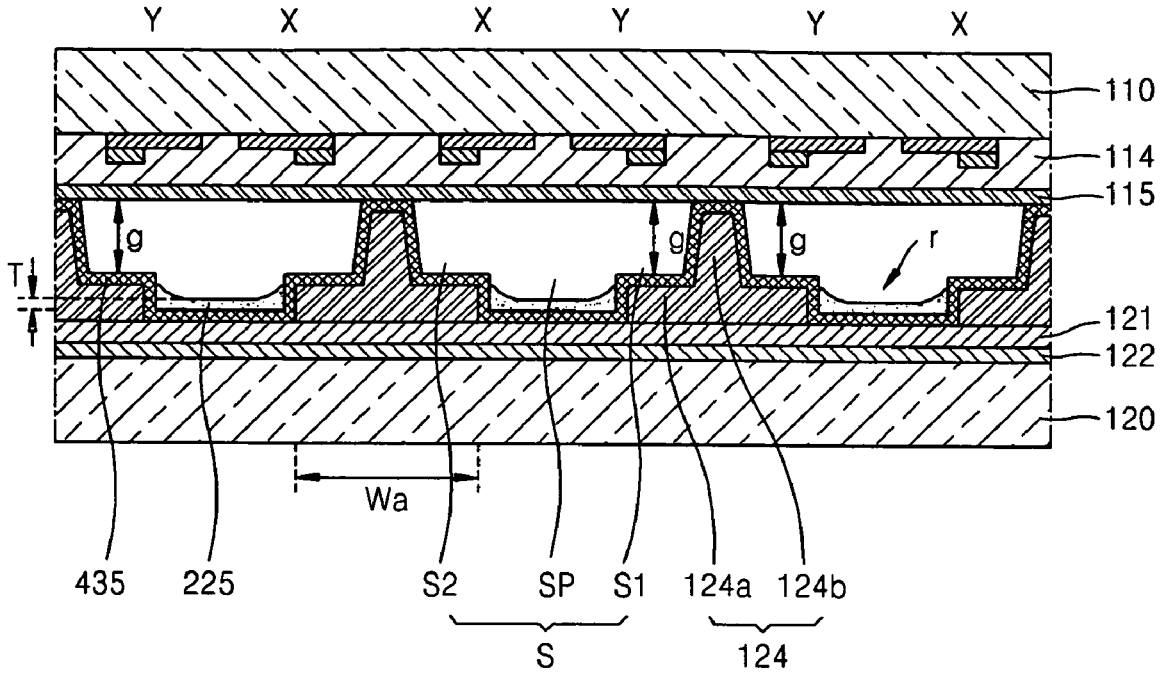
FIG. 10 illustrates a cross-sectional view of another modified PDP of FIG. 8.

FIG. 10 illustrates a cross-sectional view of another modified PDP of FIG. 8. In the current embodiment, the electron emission material layers 435 are not restricted to only in the auxiliary discharge space S1, but may extend into the main discharge space SP. For example, by an application process where an injection nozzle, injecting electron emission materials, is moved from one end of the PDP to the other end of the PDP, one electron emission material layers 435 may be formed across the main discharge space SP and the auxiliary discharge space S1. In the main discharge space SP, the phosphor layer 225 may be formed with the electron emission material layer 435. According to the application sequence, the phosphor layer 225 may be formed on the electron emission material layer 435. The electron emission material layer 435 formed in the main discharge space SP where display discharge is centralized, may react to a discharge electrical field through air gaps (not shown) between the phosphor materials and may emit secondary electrons to the main discharge space SP, thereby activating a display discharge.

Figure 11:
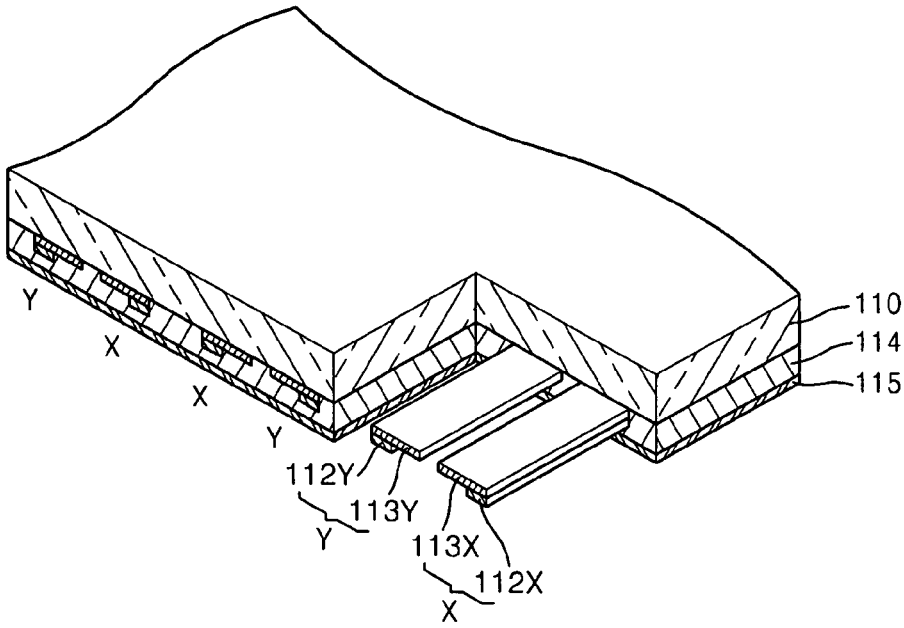
FIG. 11 illustrates an exploded perspective view of a PDP according to another embodiment.
Figure 11:
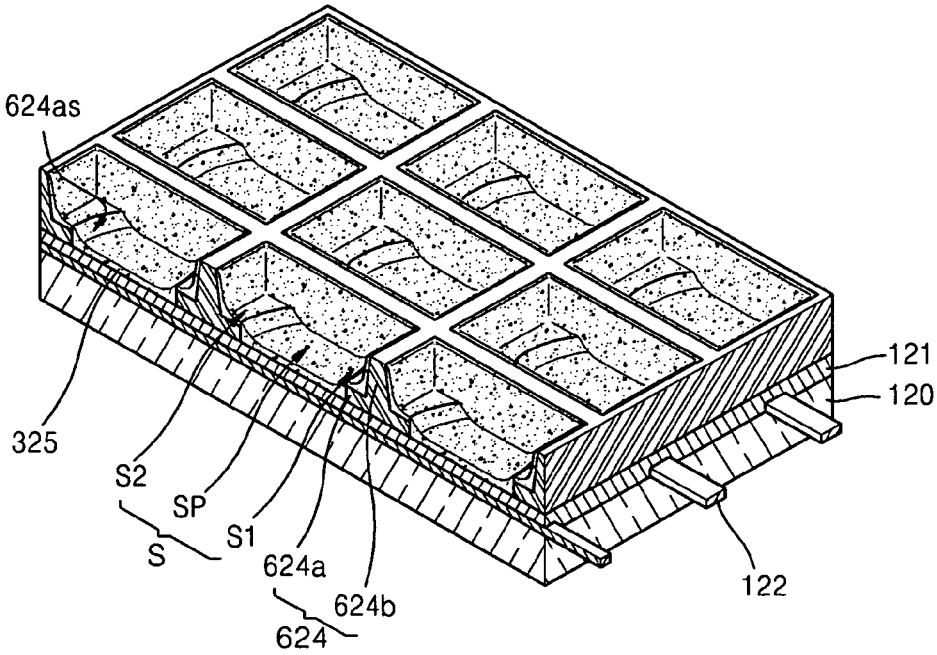

FIG. 11 illustrates an exploded perspective view of a PDP according to another embodiment.

Referring to FIG. 11, the front substrate 110, on which pairs sustain and scanning electrodes X and Y are arranged, and the rear substrate 120, on which the address electrodes 122 are arranged, may be disposed to face each other. A partition wall 624 may be interposed between the front substrate 110 and the rear substrate 120 so that a plurality of unit cells S is partitioned. Also, the auxiliary discharge spaces S1 which are adjacent to and connected to the main discharge spaces SP may be defined by the stepped partition wall 624 including a base part 624*a* and a projection part 624*b*.

Figure 12:
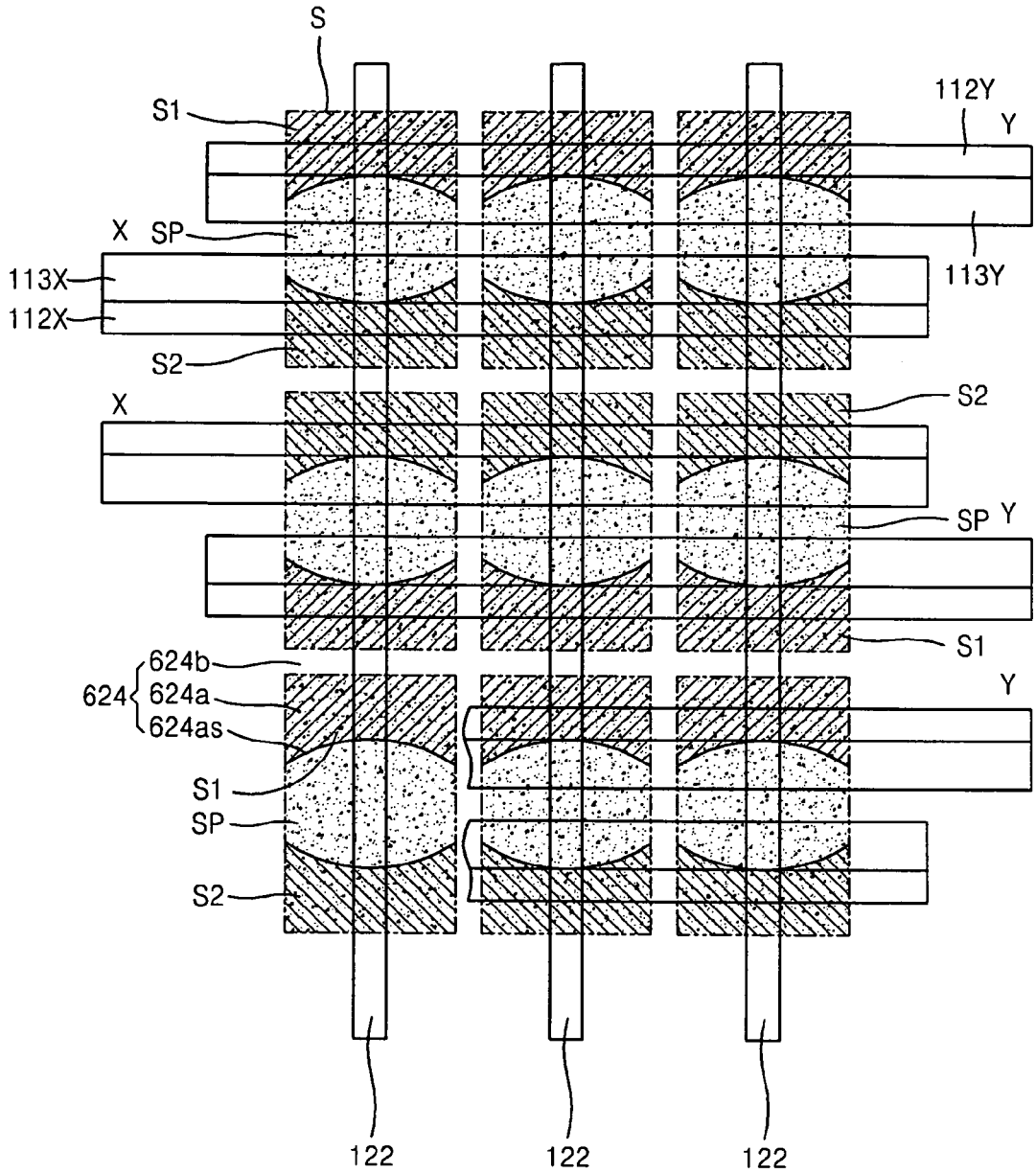
FIG. 12 illustrates a plan view of a partition wall illustrated in FIG. 11.

FIG. 12 illustrates a plan view of the partition wall 624 illustrated in FIG. 11.

Referring to FIG. 12, sides 624*as* of the base parts 624*a* forming an interface with the main discharge spaces SP may have a concave form which surrounds the center of the cell S. In other words, the sides 624*as* of the base parts 624*a* may not have a simple linear form, but, instead, may have a concave form surrounding the center of the cell S. Since the sides 624*as* of the base parts 624*a* may be formed in a concave form and may function as a surface where phosphor materials adhere thereto, an area where phosphor material are being applied may be increased, and accordingly, an improvement in light emitting luminance may be achieved. Also, since the main discharge space SP is defined by the concave-formed base part 624*a*, plasma gas generated as a result of discharge may be centralized close to the center and discharge intensity may be increased.

Figure 13:
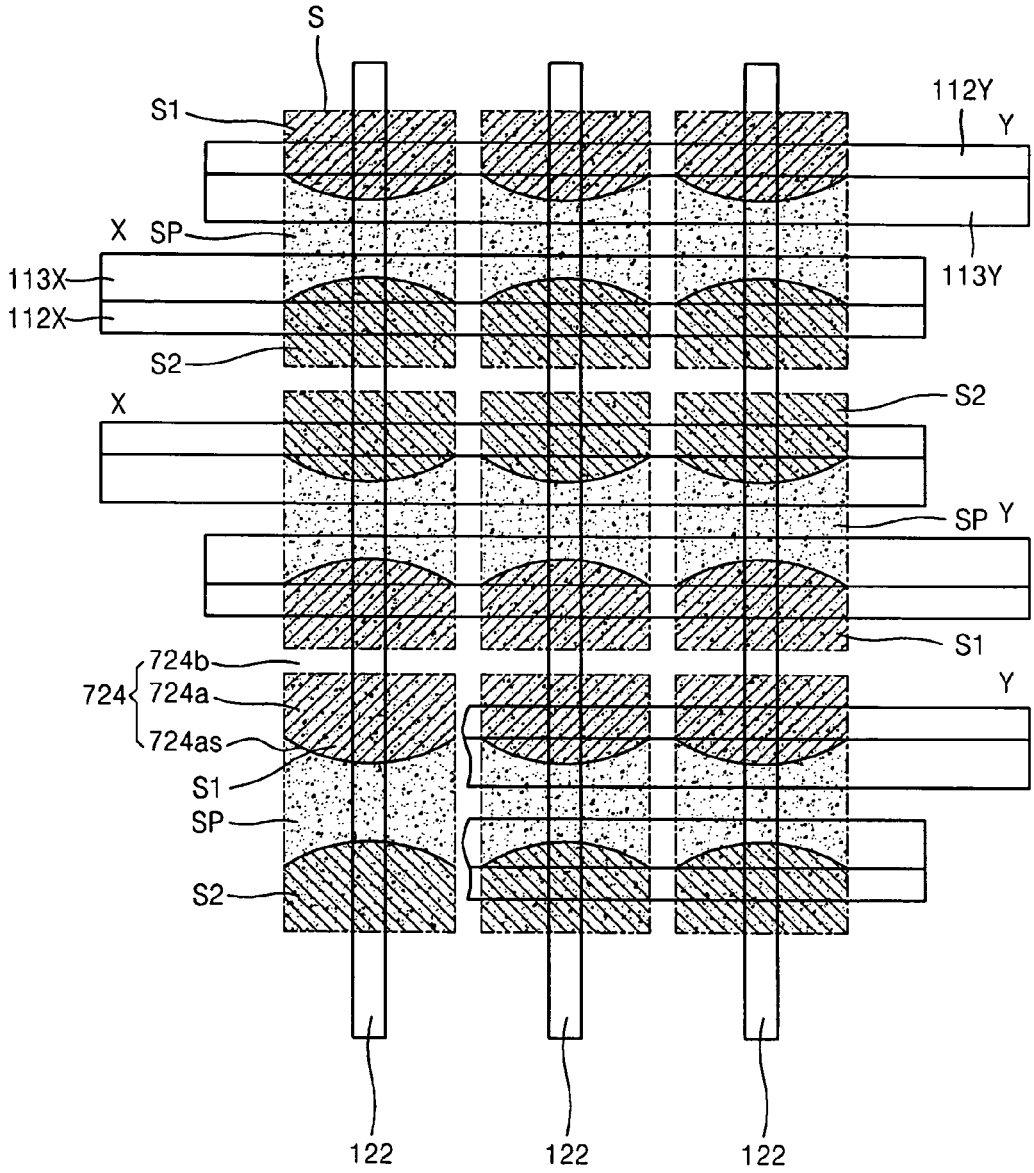
FIG. 13 illustrates a plan view of a modified partition wall of FIG. 12.

FIG. 13 illustrates a plan view of a modified partition wall 624 of FIG. 12.

Referring to FIG. 13, sides 724*as* of base parts 724*a*, which form an interface with the main discharge spaces SP, have a convex form projecting to the center of the cell S. In other words, the sides 724*as* of the base parts 724*a* may not have a simple linear form but instead, may have a convex form projecting toward the center of the cell S. Since the sides 724*as* of the base parts 724*a* are formed in a convex form and function as a surface in which phosphor materials may adhere, an area where phosphor material are being applied may be increased and an improvement in light emitting luminance may be achieved. Further, since a discharge area of the base parts 724*a* which face the scanning electrodes Y may also be increased, address discharge may be facilitated.

According to embodiments, one or more of the following effects may be achieved.

First, low voltage addressing may be possible and/or a high xenon (Xe) display may be realized so that light-emitting efficiency may remarkably be increased. Such reduced voltage requirements may be realized in accordance with embodiments by providing an auxiliary discharge space between scanning electrodes and base parts of partition walls on address electrodes. Thus, a discharge path between the scanning electrode and the address electrode is shortened to be a size of a gap between the base part and the scanning electrode. Accordingly, since the same amount of priming particles can be generated with lower address voltage, compared with a conventional PDP, driving power consumption may be reduced and/or since more priming particles may be generated with the same address voltage, light-emitting efficiency can be improved. Thus, according to embodiments in which a high electrical field suitable for address discharge is formed in a gap between a base part of a partition wall and a scanning electrode, priming particles sufficient for discharge ignition may be secured, allowing a high Xe PDP to be realized without a remarkable increase of discharge initiation voltage. Thus, light-emitting efficiency may be remarkably improved.

Second, symmetric discharge may be induced in a unit cell to provide a high-quality display. According to embodiments, an auxiliary discharge space on a side of the scanning electrode is used to generate centralized address discharge, while a symmetrical space may be formed on an opposite side of a main discharge space, i.e., on a side of the sustain electrode. Thus, the unit cell may be symmetrical with respect to a center thereof. When the unit cell is symmetrical, display discharge may not be biased to any one of the scanning electrode and the sustain electrode, but may have a symmetrical discharge. Also, a conventional asymmetrical luminance distribution in the unit cell may be prevented.

Third, discharge intervention between neighboring cells may be eliminated and reactive power consumption may be reduced. According to the electrodes arrangement of embodiments, sustain electrodes or scanning electrodes may be arranged such that electrodes of the same kind neighbor each other in adjacent unit cells. Thus, mis-discharge between neighboring cells or reactive power consumption wasted through a capacitance formed in a cell boundary may be remarkably reduced.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:

a front substrate and a rear substrate facing each other;

a partition wall interposed between the front substrate and the rear substrate to define a plurality of unit cells, each unit cell including a main discharge space, an auxiliary discharge space, and a step space, the auxiliary discharge space and the step space being on opposite sides of the main discharge spaces along stepped sidewalls of the partition wall;

pairs of scanning and sustain electrodes arranged adjacent to the auxiliary discharge spaces and to the step spaces, respectively, bus electrodes of the scanning and sustain electrodes overlapping respective auxiliary discharge spaces and step spaces;

address electrodes extending to cross the scanning electrodes at a location adjacent to the auxiliary discharge spaces;

a phosphor layer formed at least in the main discharge spaces; and discharge gas filling the unit cell, wherein a distance between outer edges of bus electrodes of a sustain electrode and a scanning electrode of a same unit cell is smaller than a width of the unit cell, the outer edges of the bus electrodes facing away from each other.

2. The PDP as claimed in claim 1, wherein the auxiliary discharge spaces and the step spaces are connected to the main discharge spaces and form the unit cells with the main discharge spaces.

3. The PDP as claimed in claim 2, wherein the auxiliary discharge space and the step space are symmetrical to each other with respect to the main discharge space.

4. The PDP as claimed in claim 1, wherein the sustain electrodes and the scanning electrodes have an electrode arrangement of X-X-Y-Y, the sustain electrodes being X and the scanning electrodes being Y, so that the sustain electrodes and the scanning electrodes neighbor each other in adjacent cells.

5. The PDP as claimed in claim 1, wherein the stepped sidewall of the partition wall includes a base part and a projection part that projects from a center of the base part, the base part being wider than the projection part to define a step form on each side of the projection part.

6. A plasma display panel (PDP), comprising:

a front substrate and a rear substrate facing each other;

a partition wall interposed between the front substrate and the rear substrate to define a plurality of unit cells, each unit cell including a main discharge space, an auxiliary discharge space, and a step space, the auxiliary discharge space and the step space being on opposite sides of the main discharge spaces along stepped sidewalls of the partition wall;

pairs of scanning and sustain electrodes arranged adjacent to the auxiliary discharge spaces and to the step spaces, respectively, bus electrodes of the scanning and sustain electrodes overlapping respective auxiliary discharge spaces and step spaces;

address electrodes extending to cross the scanning electrodes at a location adjacent to the auxiliary discharge spaces;

a phosphor layer formed at least in the main discharge spaces; and discharge gas filling the unit cell, wherein the stepped sidewall of the partition wall includes a base part and a projection part that projects from a center of the base part, the base part being wider than the projection part to define a step form on each side of the projection part, and wherein the width of the base part of the partition wall is substantially the same as a distance between an outer edge of one bus electrode to an outer edge of an adjacent bus electrode in an adjacent unit cell, the outer edge of each bus electrode facing away from its corresponding adjacent bus electrode.

7. The PDP as claimed in claim 5, wherein the base parts and respective bus lines of the scanning electrodes at least partially cover each other and are arranged to overlap each other.

8. The PDP as claimed in claim 7, wherein the base part and the bus lines of the scanning electrodes overlap each other at end parts adjacent to the main discharge space.

9. The PDP as claimed in claim 5, further comprising an electron emission material layer on a top surface of the base part in the auxiliary discharge space.

10. The PDP as claimed in claim 9, wherein the electron emission material layer is continuously formed along the top surface of the base part in the auxiliary discharge space and a side of the projection part in the auxiliary discharge space.

11. The PDP as claimed in claim 9, wherein the electron emission material layer is formed on the main discharge space as well as along the top surface of the base part in the auxiliary discharge space.

12. The PDP as claimed in claim 5, wherein a side of the base part is concave away from the main discharge space.

13. The PDP as claimed in claim 5, wherein a side of the base part is convex toward the main discharge space.

14. The PDP as claimed in claim 5, wherein the phosphor layer is not formed on the top surface of the base part interfacing with the auxiliary discharge space.

15. The PDP as claimed in claim 1, wherein the phosphor layer is on the step spaces on one side of the main discharge spaces.

16. The PDP as claimed in claim 1, wherein the phosphor layer is on the step spaces and the auxiliary discharge spaces on both sides of the main discharge spaces.

17. The PDP as claimed in claim 16, wherein the phosphor layer is formed to have a maximum thickness in the main discharge spaces.

18. The PDP as claimed in claim in claim 17, wherein the maximum thickness is substantially the same as a height of a step in the stepped sidewall of the partition wall.

19. The PDP as claimed in claim 1, wherein inner edges of bus electrodes of a sustain electrode and a scanning electrode of a same unit cell are aligned with respective innermost edges of the stepped sidewalls of the partition wall, the inner edges of the bus electrodes facing each other, and the innermost edges of the stepped sidewalls defining the main discharge space.

* * * * *